United States Patent [19]

Yamamura

[11] 4,406,649

[45] Sep. 27, 1983

[54] SHEET FOLDING MACHINE USED WITH COPYING MACHINE

[75] Inventor: Koichi Yamamura, Kanagawa, Japan

[73] Assignee: Fuji Xerox Co., Ltd., Tokyo, Japan

[21] Appl. No.: 305,319

[22] Filed: Sep. 24, 1981

[30] Foreign Application Priority Data

Oct. 1, 1980 [JP] Japan ..... 55-135778

[51] Int. Cl.[3] ..... B65H 45/14

[52] U.S. Cl. ..... 493/421; 493/458

[58] Field of Search ..... 493/419–421, 493/442–445, 458

[56] References Cited

U.S. PATENT DOCUMENTS 3,008,707 11/1961 McGarvey ..... 493/421 X
3,698,705 10/1972 Funk ..... 493/420 X
4,202,621 5/1980 Yoshimura ..... 493/420 X

FOREIGN PATENT DOCUMENTS 1205581 9/1970 United Kingdom ..... 493/444

*Primary Examiner*—A. J. Heinz
*Attorney, Agent, or Firm*—Sughrue, Mion, Zinn, Macpeak & Seas

[57] ABSTRACT

A sheet folding machine used with a copying machine has a first conveying mechanism provided in succession with the sheet discharging path of the copying machine and functioning to widthwise displace a sheet discharged through the sheet discharging path. A second conveying mechanism is arranged below the first conveying mechanism and is adapted to convey the sheet selectively in one direction and in an opposite direction. A switch assembly is provided at the sheet loading ends of the first and second conveying mechanisms for switching the delivery of the sheet to the first and second mechanisms so that the sheet is delivered through the first conveying mechanism to said second conveying mechanism or alternatively directly to the second conveying mechanism. A sheet folding mechanism disposed below the second conveying mechanism folds the sheet in two in a first direction perpendicular to the sheet conveyance direction. First and second folding mechanisms are arranged, in succession, below the sheet folding mechanism. The first folding mechanism is adapted to fold the sheet in two in the sheet conveyance direction, and the second folding mechanism is adapted to fold the sheet, which has been folded in two by the first folding mechanism, in two in a direction opposite to the sheet conveying direction. The sheet folding operation of said first folding mechanism may be inhibited and the sheet is delivered directly to the second folding mechanism. The second folding mechanism can fold the sheet in two selectively at two positions and a sheet conveying mechanism is provided at the sheet discharge side of the second folding mechanism.

12 Claims, 27 Drawing Figures

SHEET FOLDING MACHINE USED WITH COPYING MACHINE

BACKGROUND OF THE INVENTION

This invention relates to a sheet folding machine used with a copying machine, which operates to fold in two a sheet discharged from the copying machine.

An object of this invention is to provide a sheet folding machine for a copying machine, in which a sheet having a size A2 discharged from the copying machine is folded two times into one having a size A4 and is folded in four.

One preferred embodiment of this invention will be described with reference to the accompanying drawings.

BRIEF DESCRIPTION OF THE DRAWINGS

The accompanying drawings shows one embodiment of this invention, wherein.

DESCRIPTION OF THE PREFERRED EMBODIMENT

Figure 1:
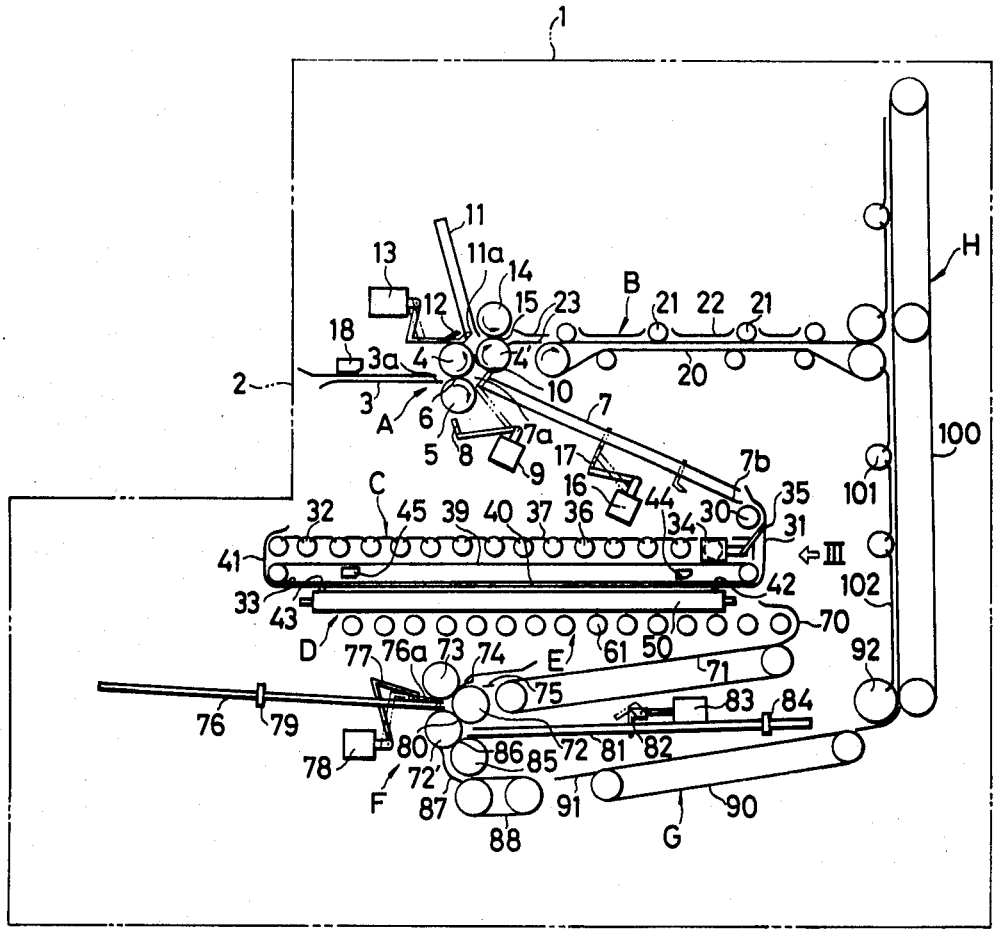
FIG. 1 is an explanatory diagram showing the entire arrangement of a sheet folding machine according to this invention.
Figure 2:
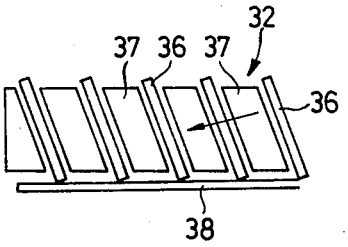
FIG. 2 is a plan view of an upper conveying mechanism in the sheet folding machine of the invention.

Referring to FIG. 1, a sheet folding machine body 1 has a sheet inlet 2 which is connected to the copied sheet discharge path of a copying machine (not shown). A first transport subsystem A is provided in succession with the sheet inlet 2. The first transport A is arranged as follows: the discharge side 3*a* of a guide 3 provided next to the sheet inlet 2 confronts with the nipping region 6 of one of a pair of folding rolls 4 and a feed roller 5. A downward pocket 7 is provided on the delivery or output side of the nipping region 6. A first gate 8 is provided at the inlet 7*a* of the downward pocket 7 in such a manner that it goes in and out of the inlet 7*a* by a first solenoid 9. An upward pocket 11 is provided at the outlet side of the nipping region 10 of the pair of folding rolls 4 and 4'.

A second gate 12 is provided at the inlet 11*a* of the upward pocket 11 in such a manner that it moves in and out of the inlet 11*a* by a second solenoid 13. An auxiliary folding roll 14 abuts against the other folding roll 4', and a second transport B is provided at the outlet side of the nipping region 15 of the rolls 14 and 4'. Furthermore, a first stopper 17 is provided for the downward pocket 7 in such a manner that it is allowed to freely go in and out by a third solenoid 16. The first stopper 17 can be freely moved between a first position (105 mm from the nipping region 10) and a second position (210 mm from the nipping region 10) and fixed there.

A second transport subsystem B comprises: a conveying belt 20; a plurality of pinch rolls 21 arranged at certain intervals and abutting against the conveying belt 20; and guides 22 disposed between the pinch rolls 21. The second transport B is coupled to the nipping region 15 through guide means 23.

A third transport subsystem C is provided at the outlet side 7*b* of the downward pocket 7. In FIG. 1, reference numeral 18 designates a sheet insertion detecting sensor. The third transport C is disposed below the first transport A and is arranged as follows: a feed roll 30 and a downward guide 31 are provided at the outlet side 7*b* of the downward pocket 7. The inlet sides of an upper conveying mechanism 32 and a lower conveying mechanism 33 extend sidewards and are provided above and below the downward guide 31. A pawl 35 is moved into and out of engagement with the downward guide 31 by a fourth solenoid 34.

The upper conveying mechanism 32 comprises: a plurality of feed rolls 36 arranged obliquely of the conveyance direction; guides 37 disposed between the feed rolls 36; and a regulating plate 38 provided along one side of the conveying mechanism 32, or in the conveyance direction. Therefore, a sheet is delivered obliquely so that it abuts against the regulating plate 38. As a result, the sheet is positioned along one side of the conveying mechanism 32; that is, the mechanism 32 has a sheet widthwise displacing function.

On the other hand, the lower conveying mechanism 33 comprises a conveying belt 39 provided below and along the array of feed rolls 36. The lower guide 40 is provided below and along the conveying belt 39. The lower guide 40 is formed integral with the downward guide 31 mentioned above. The other end portion of the lower guide 40 is bent upwardly to the outlet side of the upper conveying mechanism 32 to form an upward guide 41. First and second positioning pieces 42 and 43 ar provided at both ends, in the conveyance direction, of the lower guide 40 in such a manner that they are allowed to freely move in and out by solenoids (not shown), respectively. First and second sensors 44 and 45 are disposed between the first and second positioning pieces 42 and 43.

Figure 3:
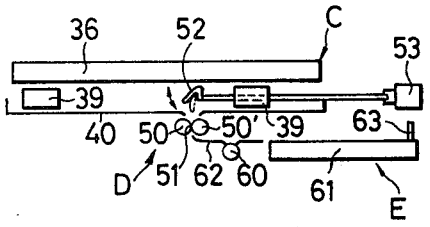
FIG. 3 is a side view of essential components of the sheet folding machine as viewed in the direction of the arrow III in FIG. 1.

A sheet folding subsystem mechanism D is provided below the third transport subsystem C to fold a sheet in a direction perpendicular to the conveyance direction. The folding mechanism D is arranged as follows: a pair of folding feed rolls 50 and 50' abutting against each other are provided below the lower guide 40 as shown in FIGS. 1 and 3 in such a manner that they extend over the conveyance distance and are rotatable perpendicular to the conveyance direction. The lower guide 40 is divided in two parts at a position corresponding to the nipping region 51 of the rolls 50 and 50'. A creasing blade 52 is provided in such a manner that it can freely move from a first position corresponding to the nipping region 51 and a second position remote from the first position. A fourth transport E is provided at the outlet side of the nipping region 51 of the folding feed rolls 50 and 50'.

The fourth transport E is arranged as follows: as shown in FIGS. 1 and 3, a feed roll 60 is provided at the outlet side of the nipping region 51. At the sheet delivery side of the feed roll 60, a plurality of rolls 61 are arranged perpendicular to the feed roll 60. A fifth transport subsystem F is provided in succession with the sheet delivery side of the array of rolls 61. In FIG. 3, reference numerals 62 and 63 designate a guide and a stopper, respectively.

The fifth transport subsystem F is disposed below the fourth transport subsystem E, and is arranged as follows: a guide 70 is provided at the delivery side of the fourth transport subsystem E. A conveying belt 71 is provided in succession with the guide 70. The conveyance end of the conveying belt 71 confronts with the nipping region 74 of one (72) of a pair of folding rolls 72 and 72' abutting against each other and a feed roll 73 abutting against the roll 72. A guide 75 is disposed between the nipping region 74 and the conveyance end of the belt 71. A third pocket 76 is provided at the outlet side of the nipping region 74. A third gate 77 moves in and out of the inlet 76*a* of the third pocket 76 by the action of a fifth solenoid 78. A stopper 79 is provided at the middle, in the longitudinal direction, of the third pocket 76. A fourth pocket 81 is provided at the outlet side of the nipping region 80 of the pair of folding rolls 72 and 72'.

A movable stopper 82 is provided at a first position (192 mm from the nipping region 80), in the longitudinal direction, on the fourth pocket 81 in such a manner that it is allowed to freely go in and out by a seventh solenoid 83. A stationary stopper 84 is provided at a second position (297 mm from the nipping region 80). An auxiliary folding roll 85 abuts against the other folding roll 72'. A guide 87 is disposed at the outlet side of the nipping region 86 of the rolls 72' and 85. In succession with the guide 87 a conveying belt 88 is provided.

Figure 4:
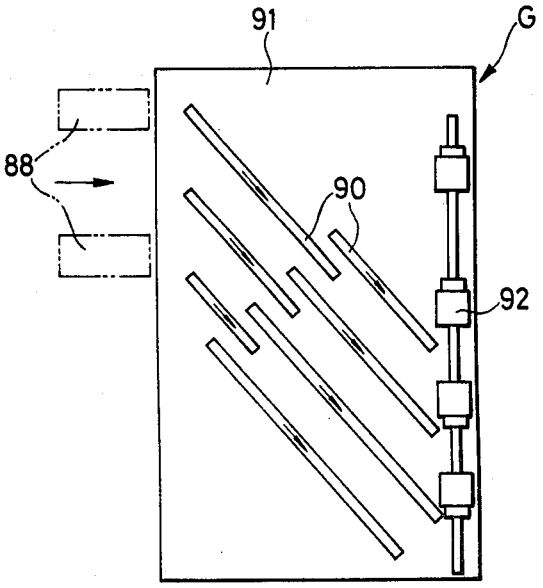
FIG. 4 is a plan view of a sixth transport in FIG. 1.
Figure 5A:
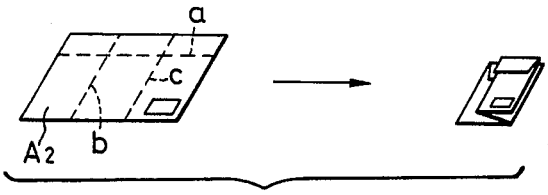
FIG. 5(*a*) through FIG. 5(*f*) illustrate folding steps of various sized sheets in accordance with this invention.
Figure 5B:
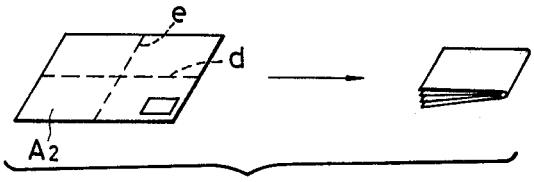
Figure 5C:
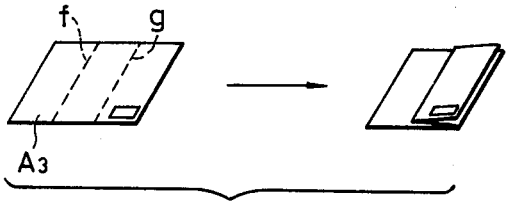
Figure 5D:
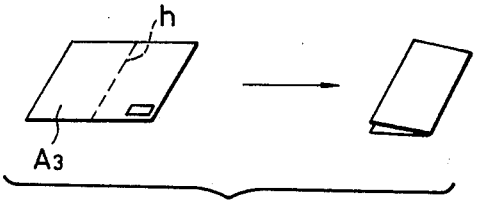
Figure 5E:
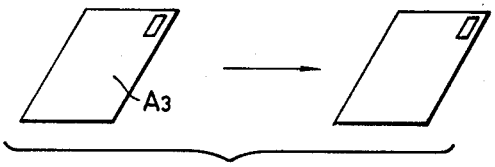
Figure 5F:
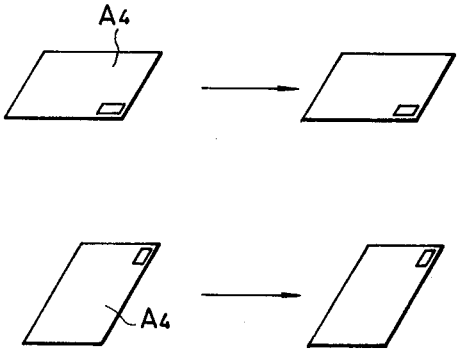

A sixth transport subsystem G is provided at the conveyance end of the conveying belt 88. The sixth transport subsystem G, as shown in FIGS. 1 and 4, comprises conveying belts 90 forming about 45° with the conveyance direction of the conveying belt 88 mentioned above. A guide 91 is provided above the conveying belts 90. At the discharge side of the guide 91, feed rolls 92 are provided, and a seventh transport subsystem H is disposed in succession with the feed rolls 92.

The seventh transport subsystem H extends vertically and is coupled to the discharge side of the second transport B described herein. It is made up of a vertically conveying belt 100, pinch rolls 101 and guides 102. The above-described feed roll 92 abuts against the loading end of the seventh transport subsystem H, and the unloading end of the conveying belt 20 of the second transport subsystem B is coupled to the middle point of the seventh transport subsystem H. The unloading end of the vertically conveying belt 100 is coupled, for example, through a sheet outlet (not shown) to a sorter (not shown).

The operation of the sheet folding machine thus constructed will be described.

(1) First, the case where a sheet A2 having the size A2 is folded a number of times; i.e., the sheet is folded in two along the line a, and is then folded in three along the lines b and c as shown in the part (a) of FIG. 5, to obtain the size B4, will be described.

Figure 6:
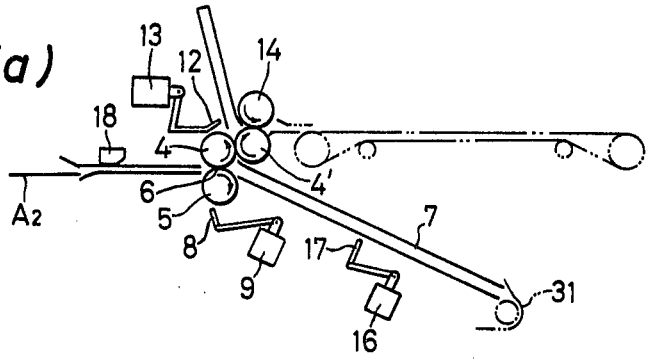
FIG. 6(*a*) through FIG. 6(*j*) illustrate the sequential operation of the sheet folding machine in accordance with this invention to fold a sheet of A2 size in a manner shown in FIG. 5(*a*)
Figure 6:
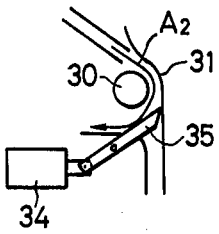
Figure 6:
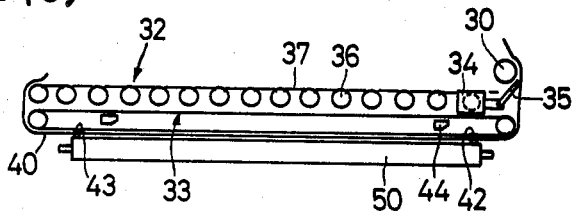
Figure 6:
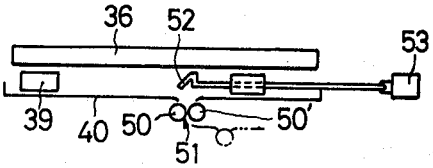
Figure 6E:
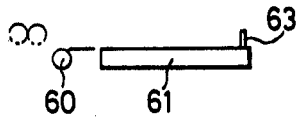
Figure 6F:
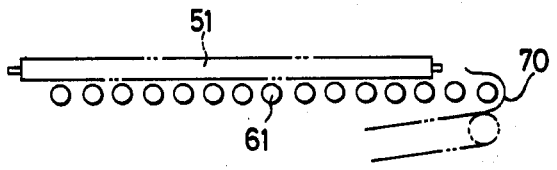
Figure 6G:
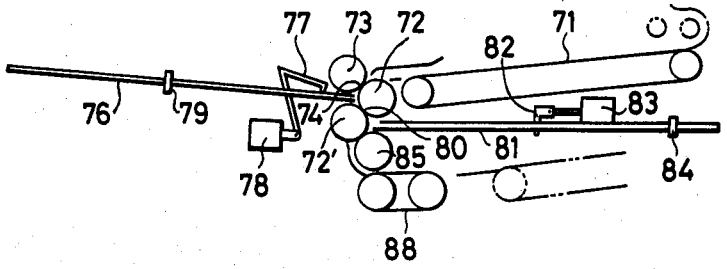
Figure 6H:
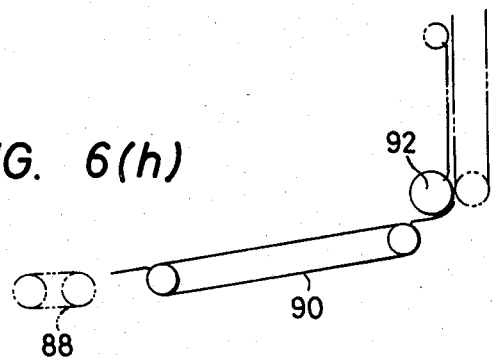
Figure 6I:
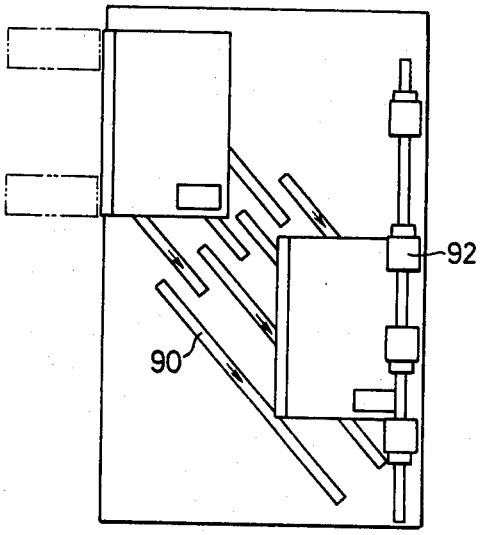
Figure 6J:
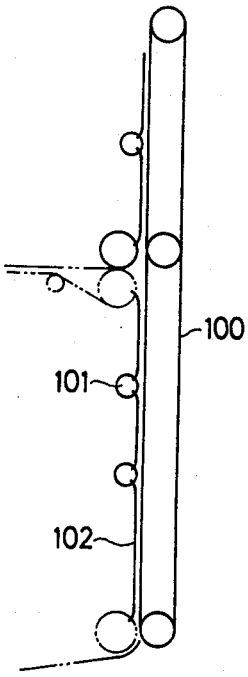
Figure 7A:
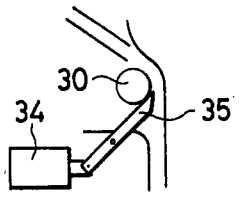
FIG. 7(*a*) through FIG. 7(*d*) illustrate the sequential operation of the sheet folding machine in accordance with this invention to fold a sheet of A2 size in a manner shown in FIG. 5(*b*)
Figure 7B:
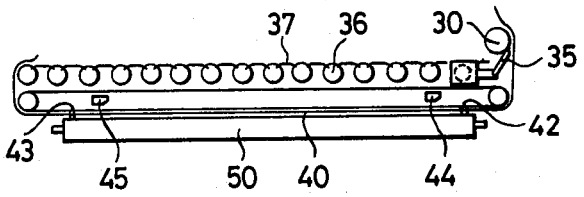
Figure 7C:
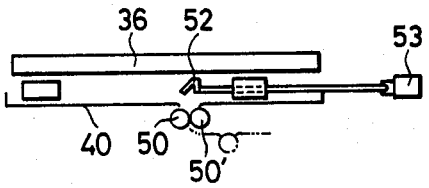
Figure 7D:
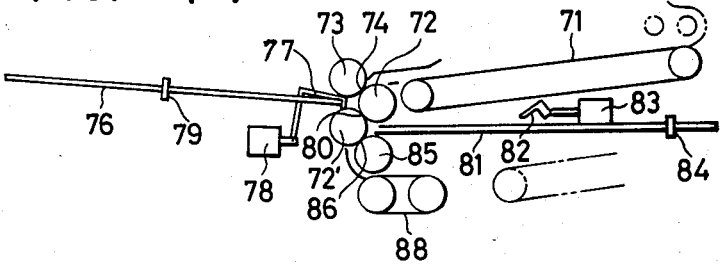

As shown in FIG. 6(*a*), the first and third solenoids 9 and 16 are deenergized to allow the first gate 8 and the first stopper 17 to go out of the first pocket 7, thereby to allow the advancement of the sheet to be folded.

Under this condition, the sheet, size A2, is inserted into the sheet inlet 2 with the longer sides in the conveyance direction. The sheet A2 thus inserted is further inserted into the nipping region 6 through the guide 3, and is then delivered into the first pocket 7 by the folding roll 4 and the feed roll 5.

The sheet A2 is delivered from the first pocket 7 to the downward guide 31 of the third transport subsystem C. In this operation, shown in FIG. 6(*b*), power is applied to the fourth solenoid 34 to cause the pawl 35 to abut against the downward guide 31. Therefore, the sheet A2 delivered to the downward guide 31 is delivered to the upper conveying mechanism 32 moving along the pawl 35. While being moved by the upper conveying mechanism 32, the sheet is displaced in the widthwise direction by the rolls 36 and the regulating plate 38. Then, the sheet is delivered through the downward guide 41 to the conveying belt 33 of the lower conveying mechanism 33. As a result, the sheet is delivered in the opposite direction along the lower guide 40 by the conveying belt 33.

In this operation, shown in FIG. 6(*c*), the first positioning piece 42 is set at the positioning position, while the second positioning piece 43 is set at the non-positioning position, and therefore the sheet A2 is stopped by the first positioning piece 42. When the front edge of the sheet is detected by the first sensor 44, as shown in FIG. 6(*d*), the fifth solenoid 53 is energized in such a manner that there is a period of time sufficient for the sheet A2 to reach the first positioning piece 42. As a result, the creasing blade 52 is set at the first position. Therefore, a longitudinal crease coincident with the aforementioned crease line a is formed in the sheet A2. As the crease is inserted into the nipping region 51 of the folding feed rolls 50 and 50', the sheet is delivered to the fourth transport subsystem E through the guide 62 and the feed roll 60 while being folded in two until it abuts against the stopper 63. This is illustrated in FIG. 6(*e*).

Thereafter, the conveyance direction of the sheet is changed by 90° by the feed rolls 61, and the sheet is delivered through the guide 70 (FIG. 6(*f*)) to the conveying belt 71 of the fifth transport subsystem E. In this operation, shown in FIG. 6(*g*), the sixth solenoid 78 is deenergized, so that the third gate 77 goes out of the third pocket 76, while the seventh solenoid 83 is energized to cause the movable stopper 82 to move into the fourth pocket 81. Therefore, the sheet A2 delivered by the conveying belt 71 is further delivered through the nipping region 74 to the third pocket 76 until it is abutting against the stopper 79. As a result, the portion of the sheet A2 corresponding to the aforementioned crease line c is inserted into the nipping region 80, shown in FIG. 6(*g*), and therefore the sheet A2 is delivered to the fourth pocket 81 while being folded in two in the longitudinal direction.

The sheet A2 thus delivered is stopped by the movable stopper 82. Thus, similarly as in the above-described case, the portion of the sheet corresponding to the aforementioned crease line b is inserted into the nipping region 86, and therefore the sheet is delivered along the guide 87 to the conveying belt 88 while being folded in two in the longitudinal direction. Thus, the sheet A2 has been folded plural times as shown in FIG. 5(*a*).

The sheet A2 thus folded is delivered onto, as shown in FIG. 6(*h*), the conveying belts 90 of the sixth transport subsystem G. The sheet A2 thus delivered is delivered to the feed rolls 92 while being displaced to one side (FIG. 6(*c*)) in the conveyance direction by the conveying belts 90. The sheet A2 is conveyed upwardly (FIG. 6(*j*)) by the vertically conveying belt 100 of the seventh transport subsystem H to a sorter (not shown).

(2) The case where, as shown in FIG. 5(*b*), sheet A2 having the size A2 is folded in two along the crease line d in the widthwise direction and is then folded in two again along the crease line e in the longitudinal direction, will now be described.

Reference is also made to FIG. 7. As in the above-described operation (1), the sheet A2 is delivered to the downward guide 31 of the third transport subsystem C. In this operation, the fourth solenoid 34 is deenergized to set the pawl 35 at the second position where the pawl 35 is set away from the downward guide 31 (FIG. 7(*a*)). Therefore, the sheet A2 is delivered along the guide 31 to the conveying belt 39 of the lower conveying mechanism 33 which is driven in the opposite direction in this case. Furthermore, in this case, the first positioning piece 42 is set at the non-positioning orientation, while the second positioning piece 43 is at the positioning orientation. Accordingly, the sheet A2 is moved along the lower guide 40 until it is stopped by the second positioning piece 43 (FIG. 7(*b*)).

When the front edge of the sheet A2 is detected by the second sensor 45, as shown in FIG. 7(*c*), the fifth solenoid 53 is energized in such a manner that there is a period of time sufficient for the sheet to reach the second positioning piece 43. As a result, the creasing blade 52 is set at the first position. Accordingly, similarly as in the above-described case, the sheet A2, after being folded in two along the crease line d in the widthwise direction, is delivered to the fourth transport E. Then, (FIG. 7(*d*)), the sheet is further delivered to the conveying belt 71 of the fifth transport F by the fourth transport E. In this case, the sixth solenoid 78 is energized to cause the third gate 77 to move in the third pocket 76 to prevent the advancement of the sheet to the third pocket 76, while the seventh solenoid 83 is deenergized to cause the movable stopper 82 to move out of the fourth pocket 81.

Accordingly, the sheet A2 inserted into the nipping region 74 is delivered into the fourth pocket 81 by the nipping region 80 and is then stopped by the stationary stopper 84. Thus, the portion of the sheet A2 corresponding to the crease line e is inserted into the nipping region 85, and the sheet A2 is delivered out while being folded in two along the crease line e in the longitudinal direction. Thus, the sheet A2 has been folded in four as shown in FIG. 5(*b*).

The sheet A2 thus folded is delivered along the guide 87 to the feed belt 88. Then, similarly as in the above-described case (1), the sheet is delivered through the sixth transport G and the seventh transport H to the sorter (not shown).

(3) The operation where a sheet A3 having the size A3 is folded multiple times as shown in FIG. 5(*c*); i.e., it is folded in two along the crease line f and is then folded in two again along the crease line g, will now be described.

Figure 8:
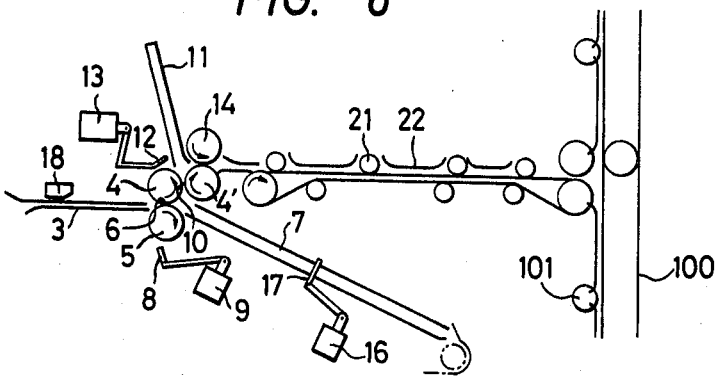
FIG. 8 illustrates the operation of the sheet folding machine in accordance with this invention to fold a sheet of A3 size in a manner shown in FIG. 5(*c*)

Reference made to FIG. 8. The sheet A3 is longitudinally moved along the guide 3 of the first transport A to be inserted into the nipping region 6. In this operation, the first gate 8 is moved out of the first pocket 7, and the second gate 12 is also moved out by the deenergization of the second solenoid 13. Furthermore, the first stopper 17 is set at the first position and is moved in by the energization of the third solenoid 16 to allow the movement of the sheet A3 to the first position in the first pocket 7. Therefore, the sheet A3 delivered through the nipping region 6 is moved into the first pocket 7 and is stopped by the first stopper 17. As a result, the portion of the sheet A3 corresponding to the crease line g is inserted into the nipping region 10, and therefore the sheet is delivered out while being folded in two along the crease line g in the longitudinal direction.

The sheet A3 thus folded is moved into the second pocket 11 to strike against the stopper 11*a*, whereupon the portion of the sheet A3 corresponding to the crease line f is inserted into the nipping region 15, and therefore the sheet is delivered out while being folded in two along the crease line f in the longitudinal direction. Thus, the sheet A3 has been folded as shown in FIG. 5(*c*).

The sheet A3 thus folded is delivered through the second transport B to the vertically conveying belt 100 of the seventh transport H and is then delivered to the sorter (not shown) by the vertically conveying belt 100.

Figure 9:
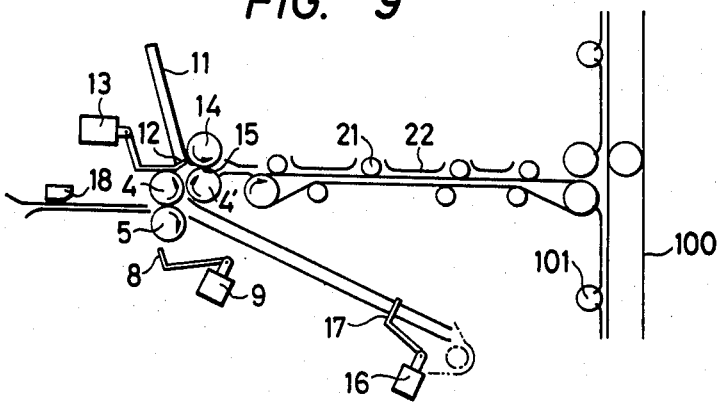
FIG. 9 illustrates the operation of the sheet folding machine in accordance with this invention to fold a sheet of A3 size in a manner shown in FIG. 5(*d*)

(4) The operation where a sheet A3 having the size A3 is folded in two along the crease line h in the longitudinal direction as shown in FIG. 5(*d*), will be described. Reference is made to FIG. 9.

Similarly as in the above-described operation (3), the sheet A3 is moved longitudinally. The first gate 8 is moved out of the first pocket, and the first stopper 17 is set at the second position and is then moved in the first pocket. Furthermore, the second solenoid 13 is energized to cause the second gate 12 to move in the second pocket 11. Therefore, the sheet A3 delivered through the nipping region 6 is moved into the first pocket 7 and is detained by the first stopper 17. As a result, the portion of the sheet A3 corresponding to the crease line h is inserted into the nipping region 10, and therefore the sheet A3 is delivered out while being folded in two along the crease line h in the longitudinal direction. Thus, the sheet A3 has been folded in two. Because the movement of the sheet into the second pocket 11 is prevented by the second gate 12, the sheet is delivered into the nipping region 15 and is then delivered to the second transport B. Thereafter, the sheet A3 is moved in the same manner as that in the operation (3) described above.

Figure 10:
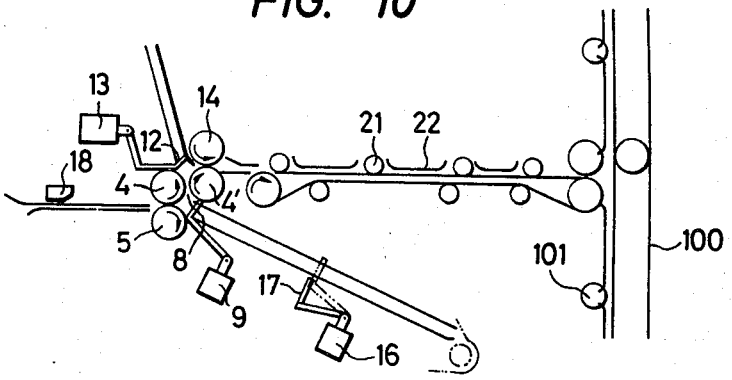
FIG. 10 illustrates the operation of the sheet folding machine in accordance with this invention to discharge a sheet of A4 size without folding as illustrated in FIGS. 5(*c*) and 5(*f*).

(5) The operation where a sheet A3 of the size A3 or a sheet A4 of the size A4 is discharged without being folded, as shown in FIG. 5(*e*) or (*f*), will be described. This is illustrated in FIG. 10.

Under the conditions that the first and second solenoids 9 and 13 are energized to cause the first and second gates 8 and 12 to move in the first and second pockets 7 and 11 so that the movement of the sheet thereinto is prevented, the sheet is inserted. Then, the sheet is delivered to the second transport B through the nipping regions 6 and 16. The sheet thus delivered is further delivered to the sorter (not shown) through the second and seventh subsystem transports B and H.

As was described above, a sheet having the size A2 delivered out of the copying machine can be folded into the size A4 or can be folded in four.

It is apparent that the invention can be modified without departing from the essential scope thereof.

What is claimed is:

1. A sheet folding machine comprising:

a sheet inlet section having a sheet folding means including a pair of folding rollers and a feed roller located adjacent loading ends of a discharge section and a sheet receiving pocket, said sheet folder means having a plurality of pockets for receiving a sheet including said sheet receiving pocket, means disposed in a sheet conveying path in said sheet receiving pocket for selectively blocking said sheet receiving pocket to cause said sheet to either pass through said folder means for folding and then to said discharge section or allowing said sheet to pass through said sheet conveying path;

first conveying means placed in a sheet discharge path of said sheet receiving pocket for displacing said sheet in a widthwise direction;

second conveying means on said discharge path downstream of said first conveying means for conveying said sheet selectively in one direction and in an opposite direction;

switch means disposed at sheet loading ends of said first and second conveying means for switching the delivery of said sheet to said first and second conveying means wherein said sheet is delivered through said first conveying means to said second conveying means or directly to said second conveying means;

sheet folding means in the discharge path of said second conveying means for folding said sheet in a first direction;

first and second folding mechanisms arranged in succession and receiving a sheet from said sheet folding means, said first folding mechanism folding said sheet in two in the sheet discharge path direction and said second folding mechanism adapted to fold said sheet in two in a direction opposite to said sheet discharge path direction;

means for inhibiting the folding operation of said first sheet folding mechanism and delivering said sheet directly to said second sheet folding mechanism;

means for folding said sheet in two positions in said second sheet folding mechanism; and a sheet conveying mechanism provided at the sheet discharge side of said second sheet folding mechanism.

2. The folding machine of claim 1, wherein said second conveying means is positioned below said first conveying means and further comprising a downward guide for guiding a sheet to either said first or second conveying means.

3. The feeding machine of claim 2, wherein said switch means comprises a pawl positioned in the path of said downward guide to gate said sheet to either said first or second conveying means and, solenoid means to actuate said pawl.

4. The feeding machine of claim 1, wherein said sheet folding means comprises means to fold said sheet in a direction perpendicular to said discharge path of said second conveying means.

5. The feeding machine of claim 1, wherein said sheet folding means is positioned beneath said second conveying means.

6. The folding machine of claim 1, wherein said sheet folding means comprises a pair of folding feed rollers abutting against each other and rotatable in a direction perpendicular to said sheet discharge path and a creasing blade movable to a nipping region between said folding feed rollers to crease said sheet and urge it through said folding feed rollers.

7. The folding machine of claim 1, wherein said first and second folding mechanisms each comprise a pair of folding rollers, and stop means positioned a predetermined distance from said folding rollers to position a portion of said sheet in a nip region at a respective folding roller to fold said sheet along a predetermined crease line.

8. The folding machine of claim 1, wherein said means for inhibiting comprises gate means blocking the advancement of said sheet into said first sheet folding mechanism and actuating means for positioning said gate.

9. The folding machine of claim 1, wherein said sheet conveying mechanism comprises a first conveying belt inclined to said second sheet folding mechanism, a second conveying belt disposed in a substantially vertical direction, pinch rollers to hold said sheet on said second conveying belt and, guide means interposed between said first and second conveying belts.

10. The folding machine of claim 1, further comprising input means having a gate means to selectively pass said sheet to said first conveying means.

11. The folding machine of claim 10, further comprising a pocket having a movable stopper, and a pair of folding rollers positioned relative to said pocket to fold said sheet when it engages said stopper, and said gate means is selectively positioned in said pocket.

12. The folding machine of claim 11, wherein said input means further comprises a second pocket, said gate means operative to guide said sheet from said first pocket into said second pocket and delivery means to convey said sheet from said second pocket to said sheet conveying mechanism.

* * * * *